US005257318A

United States Patent [19]

Carroll

[11] Patent Number: 5,257,318

[45] Date of Patent: * Oct. 26, 1993

[54] EARPHONE SPACER WITH ELECTRONICALLY VARIABLE SOUND LEVEL

[76] Inventor: Robert J. Carroll, 207 Highland Ave., Winchester, Mass. 01890

[ * ] Notice: The portion of the term of this patent subsequent to Feb. 12, 2008 has been disclaimed.

[21] Appl. No.: 653,187

[22] Filed: Feb. 11, 1991

Related U.S. Application Data

[63] Continuation-in-part of Ser. No. 295,493, Jan. 11, 1989, Pat. No. 4,993,074.

[51] Int. Cl.[5] ..... H04R 1/28

[52] U.S. Cl. ..... 381/187; 381/183; 381/74; 381/205

[58] Field of Search ..... 381/74, 187, 183

[56] References Cited

U.S. PATENT DOCUMENTS

| | | | |
|---|---|---|---|
| 1,747,778 | 2/1930 | Küchenmeister | 381/183 |
| 3,488,457 | 1/1970 | Lahti | 381/183 |
| 3,751,608 | 8/1973 | Weingartner | 381/187 |
| 3,789,164 | 1/1974 | Ryder | 381/183 |
| 4,302,635 | 11/1981 | Jacobsen et al. | 381/183 |
| 4,523,661 | 6/1985 | Scalzo et al. | 381/187 |
| 4,529,057 | 7/1985 | Telford | 381/187 |
| 4,572,324 | 2/1986 | Fidi et al. | 381/187 |
| 4,993,074 | 2/1991 | Carroll | 381/187 |

FOREIGN PATENT DOCUMENTS

| | | | |
|---|---|---|---|
| 2353708 | 5/1975 | Fed. Rep. of Germany | 381/183 |
| 2451427 | 5/1975 | Fed. Rep. of Germany | 381/183 |
| 53-41219 | 4/1978 | Japan | 381/183 |
| 53-88718 | 8/1978 | Japan | 381/183 |

*Primary Examiner*—James L. Dwyer
*Assistant Examiner*—Fan Tsang
*Attorney, Agent, or Firm*—John M. Brandt

[57] ABSTRACT

A spacing device which holds earphones away from the ears to create a sense of live music when the earphones are used in conjunction with loudspeakers. The spacers allow sound from loudspeakers set away from the user to reach the ear from all directions. A volume control connected between the earphones and amplifier provides sound level adjustment for creating an optimal condition of presence as sensed by the listener.

5 Claims, 1 Drawing Sheet

EARPHONE SPACER WITH ELECTRONICALLY VARIABLE SOUND LEVEL

This application is a continuation-in-part of application Ser. No. 07/295,493 now U.S. Pat. No. 4,993,074 filed Jan. 11, 1989 by the same inventor.

BACKGROUND OF THE INVENTION

1. Field of the Invention:

The invention relates to devices for enchancing the quality and realism of electronically reproduced sound. In particular, it relates to a device which allows sound from both earphones and speakers powered by the same source to be heard simultaneously.

2. Description of the Prior Art:

Various electronic sound delay/sound attenuation systems have been used to increase the sense of realism when playing back music via loudspeakers. These systems take musical signals from a primary amplifier and feed them to a computer or other type of processor which in turn feeds the signals to a secondary amplifier and secondary set of speakers. While the primary amplifier drives speakers placed in front of the listeners, the electronic delay system feeds information to the secondary amplifier which drives speakers placed behind the listeners. The more sophisticated systems delay and attenuate frequency separately and randomly for each channel. Users can alter the delay time to simulate ambiance that would be present in rooms of varying size.

These electronic sound delay systems are expensive, some of them display limited results, and to date have not become a popular part of the average listeners' stereo system. However, similar and perhaps superior increases in ambiance or presence (that is, the sense of being at a "live" concert) can be created, by use of the present invention, without specialized electronic delay systems. By using the standard listener distance of six to eight feet or more for stereo sound away from loudspeakers and by simultaneously listening to earphones that are held just off the ears by the invention and that are connected to the same amplifier that is driving the loudspeakers, a dramatic increase in depth and ambiance of sound will be experienced.

The above referenced patent describes a number of prior art devices relating to earphones which were pertinent to the invention disclosed therein. That invention accomplished the intended result of producing ambiance by providing an earphone spacer which optionally could be adjusted by stacking one or more additional spacers or by employing threaded coaxial tubes which screw in and out.

The present invention is an improved alternative to achieving optimal ambiance effect by electrically varying the sound level of the earphones rather than adjusting the distance of the earphone from the ear by varying the width of the spacer.

This is accomplished by providing in addition to a fixed spacer, a volume control or variable resistance between the earphones and the amplifier.

In use, the control is then adjusted until the listener experiences the greatest presence or ambiance for a particular sound system, pair of earphones and listener location.

SUMMARY OF THE INVENTION

The invention may be summarized as a device for creating increased listener perceived presence in the reproduction of recorded sound in which a pair of sound admitting spacers are employed to hold a pair of earphones a selected distance from the ear and in which an electronic volume control is used to adjust the sound level of the earphones. In applicant's previous invention, the spacers were restricted to a cylindrical geometric configuration because of the chosen method of achieving optimum presence by adjusting the effective width of the spacer. However, it has now been discovered that the same result may be accomplished by the use of a volume control and a fixed spacer, thus allowing a greater flexibility in the shape and construction of the spacer.

The volume control is connected to the same amplifier terminal as the speakers or may optionally be inserted directly into the amplifier earphone jack providing such a connection does not automatically disconnect the speakers.

The objects and features of the invention will become more clear from the description of the preferred embodiment and drawings which follow.

DESCRIPTION OF THE PREFERRED EMBODIMENT

Figure 1:
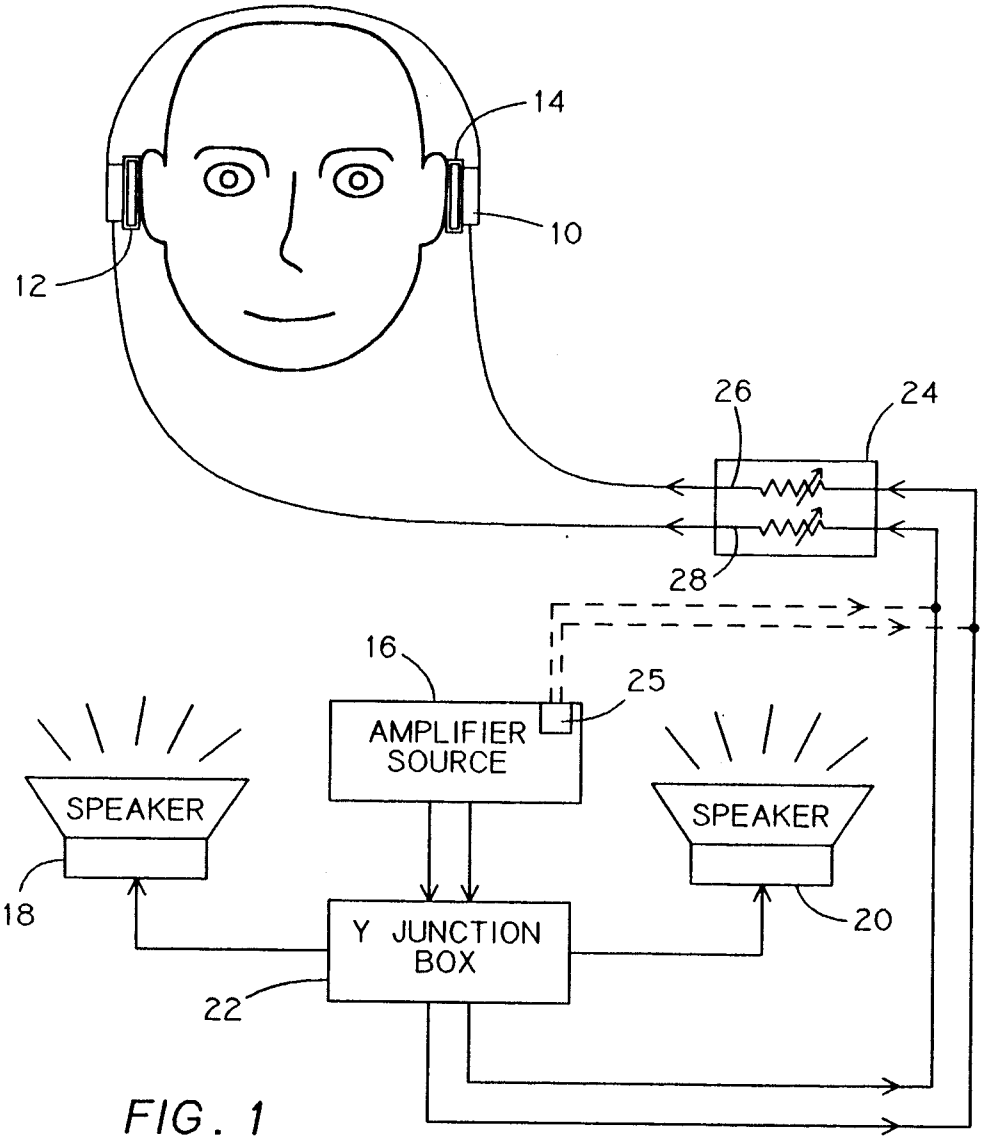
FIG. 1 is a schematic diagram of the preferred embodiment of the invention.

Referring to FIG. 1, a schematic illustration of the preferred embodiment of the invention is shown in which earphone spacers 10 are held a selected distance away from the ears by sound admitting spacers 12 and 14. Amplifier source 16 provides an output sufficient to power speakers 18 and 20 connected through Y junction box 22. Volume control 24 preferably having individually adjustable potentiometers 26 and 28 is similarly connected to junction box 22 and to earphones 10. Optionally control 24 may be connected directly to the commonly provided earphone jack 25 in most amplifiers provided such does not automatically disconnect the speakers.

The listener by using the above described device may now set the sound emanating from the earphones to a level which correctly complements that entering the ear through the spacers from the speakers to obtain the optimal presence or ambiance effect.

Figure 2:
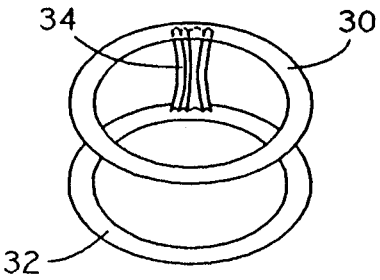
FIG. 2 is a perspective view of one form of a component of the preferred embodiment.

Referring next to FIG. 2, a spacer configuration suitable for the practice of the invention is shown in which rings 30 and 32 providing transverse surfaces for the spacer, are held in spaced apart relationship by corrugated column 34.

Figure 3:
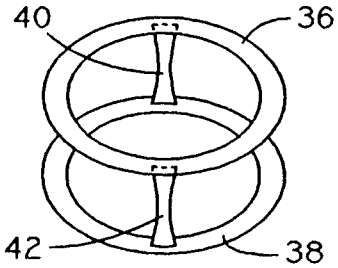
FIG. 3 is a perspective view of an alternative form of the component of FIG. 2.

FIG. 3 shows an alternative spacer configuration in which rings 36 and 38 providing transverse surfaces for the spacer, are separated and attached by a pair of posts 40 and 42.

Figure 4:
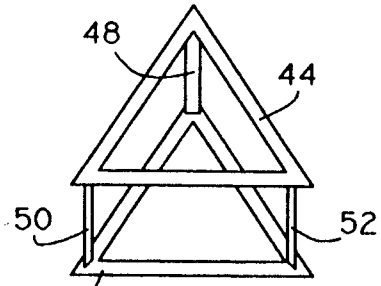
FIG. 4 is a perspective view of another alternative form of the component of FIG. 2.

FIG. 4 illustrates another form of construction in which triangular rings 44 and 46 providing transverse surfaces for the spacing, are held apart by posts 48, 50, and 52 one each at the apex of each triangular member.

The spacers may be held in place in any convenient manner, by for example, a separate headband or by a pressure sensitive adhesive not shown but as would be obvious to those skilled in the art.

Similarly a screen may be placed across one or both of the rings of each type to facilitate the use of different size earphones. Additionally padding may be used around one ring to provide more comfort in the contact region of the ear. Such devices have been disclosed in applicant's prior applications and patents.

Accordingly, the invention is defined by the following claims.

What is claimed is:

1. A system for creating an increased presence in the reproduction of sound by an amplifier, a pair of speakers, and a pair of earphones comprising in combination:

a. a pair of spacers for holding said earphones a selected distance from the ear, said spacers having at least one port covering a substantial portion of said transverse surface of said spacer to allow the unimpeded transmission of ambient sound to the ear; and b. a variable volume control positioned between said amplifier and said earphones for adjusting the level of sound emanating from said earphones.

2. The apparatus of claim 1 wherein said volume control comprises a pair of potentiometers one for each of said pair of earphones.

3. The apparatus of claim 1 wherein said spacers comprise a pair of rings rigidly attached by a corrugated column.

4. The apparatus of claim 1 wherein said spacers comprise a pair of rings rigidly attached by a pair of spaced apart posts.

5. The apparatus of claim 1 wherein said spacers comprise a pair of triangular rings rigidly attached by three equally spaced apart posts.

* * * * *